US006969285B2

(12) United States Patent
Kobayashi

(10) Patent No.: US 6,969,285 B2
(45) Date of Patent: Nov. 29, 2005

(54) BUS BAR INSERTION INDICATING STRUCTURE FOR AN ELECTRICAL CONNECTOR BOX

(75) Inventor: Nobuchika Kobayashi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/900,198

(22) Filed: Jul. 28, 2004

(65) Prior Publication Data

US 2005/0026471 A1 Feb. 3, 2005

(30) Foreign Application Priority Data

Jul. 30, 2003 (JP) ..... 2003-203781

(51) Int. Cl.[7] ..... H01R 11/09
(52) U.S. Cl. ..... 439/723
(58) Field of Search ..... 439/723, 724, 439/76.1, 76.2, 949, 595

(56) References Cited

U.S. PATENT DOCUMENTS 4,959,626 A * 9/1990 Mouissie ..... 333/182
5,405,035 A 4/1995 Kato
5,868,583 A * 2/1999 Naitou et al. ..... 439/76.2

FOREIGN PATENT DOCUMENTS

JP 6-325815 11/1994
JP 9-055269 2/1997
JP 10-243531 9/1998

OTHER PUBLICATIONS

English language Abstract of JP 10-243531.
English language Abstract of JP 9-55269.
English language Abstract of JP 6-325815.

* cited by examiner

*Primary Examiner*—Phuong Dinh
(74) *Attorney, Agent, or Firm*—Greenblum & Bernstein, P.L.C.

(57) ABSTRACT

An electrical connector box structure that provides external visual indication of an incompletely assembled position of a press fit bus bar. A wire crimping portion is provided on one side of a base plate of press fit bus bar, and terminals, which project from the other side of the base plate, are provided for connection to electrical components. The bus bar also includes a lock aperture that locks the bus bar into a bus bar chamber, and a stop flange formed as an outwardly bent portion located beneath the lock aperture. A flexible flange, on which a lock ridge is formed, opposes stop flange. The incomplete insertion of bus bar results in stop flange failing to move over the lock ridge, thus pressing flexible flange outward in the direction opposite to the lock ridge to provide visual indication of the incomplete insertion condition.

20 Claims, 9 Drawing Sheets

BUS BAR INSERTION INDICATING STRUCTURE FOR AN ELECTRICAL CONNECTOR BOX

BACKGROUND OF THE INVENTION

1. Field of the Invention

The present invention relates to an automotive electrical box structure for indicating incomplete insertion of a bus bar, and more particularly to an indicating structure whereby a part of the electrical connector box becomes visibly displaced if the bus bar has not been completely inserted and locked at the specified position.

2. Description of Background Information

FIG. 8 illustrates a relay box of the type contained in an automotive electrical connector box. Press fit bus bar 1 (hereafter referred to as bus bar 1) is inserted and locked into relay box 2 from beneath. Wire crimping part 1*a*, into which the end of wire W is crimped, extends from the lower edge of bus bar 1, and multiple terminals 1*b* are formed along the upper edge to distribute electrical power. Terminals 1*b* connect to relays and fuses which are installed in the upper side of relay box 2. When the wire harness is assembled, electrical wires are crimped to bus bar 1, bus bar 1 is inserted into relay box 2, and upper cover 3 and lower cover 4 are assembled around relay box 2 after transport to the next assembly station.

When bus bar 1 is installed in relay box 2, however, there is a chance that bus bar 1 will not be inserted completely to the specified position within relay box 2, thereby resulting in incomplete attachment. If this incomplete attachment is unnoticed, the relays and fuses will connect poorly, or not at all, thus resulting in the necessity of reassembling the electrical connector box.

Japanese Kokai (laid open) Patent No. H6-325815 attempts to rectify this problem through a structure in which, as illustrated in FIGS. 9A and 9B, rear holder 9 is used to secure the position of terminal 8 within terminal chamber 7 of electrical connector box 5. More specifically, push tab 9*b* extends downward from the lower side of base plate 9*a* of rear holder 9, and flange 9*c* bends outward from the lower edge of push tab 9*b* toward the sidewall of lower case 6. Pushing lower case 6 upward to assemble electrical connector box 5 results in upper edge 6*a* of lower case 6 pressing upward against the lower side of flange 9*c*, thus securing rear holder 9 in the specified position.

However, because connector box 5 uses lower case 6 to secure rear holder 9 in the specified position, there is no visible external indication that rear holder 9 has been inserted completely. Therefore, even though lower case 6 has been installed, flange 9*c* of rear holder 9 may not be making full contact with upper edge 6*a* of lower case 6, thus making it difficult to determine if rear holder 9 has been inserted in the specified position or not. The assembly quality cannot be determined from an external examination, and even if lower case 6 is removed, it still cannot be visually verified that rear holder 9 is completely installed.

SUMMARY OF THE INVENTION

The present invention, in consideration of the previously noted shortcomings in the prior art, provides a low cost structure capable of easily and reliably indicating the incomplete insertion of a bus bar in an automotive electrical connector box whereby a separate incomplete insertion indicating mechanism is not required.

The present invention provides an electrical connector box structure able to provide indication of the incomplete insertion of a press fit bus bar.

In this structure, the bus bar is formed from a base plate on which a wire crimping portion is formed on one edge, and from which electrical component connecting terminals protrude from the other edge.

A stop pawl or lock pawl is formed as an inwardly extending portion of the sidewall of the chamber, and a stop dog is formed on the stop pawl, the stop dog may be inserted into a lock aperture in the bus bar. The bus bar base plate includes a stop flange formed as a bent portion located beneath the lock aperture.

A flexible flange, onto which a lock ridge is formed, is provided on the side of the chamber sidewall opposite to the bus bar stop flange. Failure to insert the bus bar to the specified position in the chamber results in the stop flange pressing the flexible flange outward in a direction opposite to the extending direction of the lock ridge, and thus provides indication of an incompletely inserted bus bar.

In the event that the bus bar is incompletely inserted within the electrical connector box, the flexible flange, which is formed on the sidewall of the chamber, is pushed out in the direction opposite the lock ridge. The technician is therefore able to visually check if the flexible flange is protruding, verify if the insertion is complete, and thus prevent faulty connections to improve product quality. Further, this structure, which simply forms a portion of the case sidewall as a flexible flange, lowers costs by eliminating the need for a separate mechanism to indicate a faulty connection.

It is preferable that the lock apertures and lock flanges be formed at the left and right ends of the bus bar base plate bordering the terminals that connect to electrical components. Because the stop edges formed on both sides of the base plate lock against the lock ridges on the chamber, bus bar distortion is prevented, and the multiple terminals aligned on the base plate can all be properly and linearly inserted, thus providing for positive and reliable connection of the mating terminals.

Further, in a case where the base plate is formed with larger dimensions to accommodate a large number of terminals, one or more additional lock apertures and lock tabs may be provided at the mid portion of the base plate.

A projecting lip portion may be formed on the lower end of the flexible flange to an extent that does not block a terminal insertion cavity provided on the side of the flexible flange opposite the chamber. In the event that the bus bar has been incompletely inserted, the stop flange presses the flexible flange outward to the extent that the lip portion blocks the terminal insertion cavity, thereby forming an additional mechanism that signals an incompletely inserted bus bar.

This structure, through which an adjacent terminal insertion cavity is blocked if the bus bar is incompletely inserted, provides a highly dependable method of verifying that the bus bar has been completely inserted, especially in cases where the insertion condition of the bus bar has not been inspected.

An aspect of the present invention provides a bus bar insertion indication device for an electrical connector box, the electrical connector box including: a chamber within the electrical connector box, the chamber including sidewalls; a press fit bus bar configured to be inserted into the chamber within the electrical connector box, the bus bar including a base plate, a wire crimping portion formed on one edge of the base plate, and electrical component connecting terminals projecting from a second edge of the base plate; a lock aperture provided on the press fit bus bar; a stop flange provided on the base plate of the press fit bus bar, the stop flange including a bent portion spaced from the lock aperture; a stop pawl provided on a first sidewall of the chamber, and a stop dog provided on the stop pawl, the stop dog configured to be inserted into the lock aperture in the press fit bus bar; and a flexible flange extending from a sidewall of the chamber adjacent the stop flange, and a lock ridge projecting from the flexible flange, wherein complete insertion of the press fit bus bar into the chamber is indicated by the stop flange being supported by the lock ridge, and incomplete insertion of the press fit bus bar into the chamber is indicated by the stop flange pressing the flexible flange outward in a direction opposite to the projecting direction of the lock ridge.

In a further aspect of the present invention, the lock aperture and stop flange are provided on a side of the base plate at a position bordering the terminals that connect to electrical components. The bus bar insertion indication device for an electrical connector box may further include a projecting lip portion provided on a lower end of the flexible flange and extending such that the projecting lip portion does not block a terminal insertion cavity provided adjacent the flexible flange; wherein incomplete insertion of the press fit bus bar into the chamber is indicated by the press fit bus bar pressing the flexible flange outward so that the projecting lip portion blocks the terminal insertion cavity, thereby preventing the insertion of a terminal therein. The bus bar insertion indication device for an electrical connector box may further include a second lock aperture provided on the press fit bus bar; and a second stop flange provided on the base plate of the press fit bus bar, the second stop flange including a bent portion spaced from the second lock aperture; wherein the lock aperture and the stop flange, and the second lock aperture and the second stop flange, are provided on left and right sides, respectively, of the base plate at positions bordering the terminals that connect to electrical components.

In a further aspect of the present invention, the stop pawl projects into the chamber from the sidewall of chamber. Further, stop pawl is formed integrally and in one piece with the chamber. The flexible flange is formed integrally and in one piece with the chamber. The flexible flange extends from a sidewall opposite the stop pawl, the lock ridge projecting toward the stop pawl. The bus bar insertion indication device for an electrical connector box may further include a plurality of lock apertures provided on the press fit bus bar; and a plurality of stop flanges provided on the base plate of the press fit bus bar, the plurality of stop flanges each including a bent portion spaced from a respective lock aperture; a plurality of stop pawls provided on a first sidewall of the chamber, and a stop dog provided on each of the plurality of stop pawls, the stop dogs configured to be inserted into a respective lock aperture in the press fit bus bar.

A further aspect of the present invention provides a bus bar insertion indication device for an electrical connector box including a press fit bus bar configured to be inserted into a chamber within the electrical connector box, the bus bar including a base plate, a wire crimping portion formed on one edge of the base plate, and electrical component connecting terminals projecting from a second edge of the base plate; a lock aperture provided on the press fit bus bar; and a stop flange provided on the base plate of the press fit bus bar, the stop flange including a bent portion spaced from the lock aperture; wherein complete insertion of the press fit bus bar into the chamber is indicated by the stop flange being supported by a lock ridge projecting from a flexible flange in the chamber, and incomplete insertion of the press fit bus bar into the chamber is indicated by the stop flange pressing the flexible flange outward in a direction opposite to the projecting direction of the lock ridge.

A further aspect of the present invention provides a bus bar insertion indication device for an electrical connector box including a chamber within the electrical connector box, the chamber including sidewalls; a stop pawl provided on a first sidewall of the chamber; a stop dog provided on the stop pawl, the stop dog configured to be inserted into the lock aperture in the press fit bus bar; and a flexible flange extending from a sidewall of the chamber adjacent the stop flange, and a lock ridge projecting from the flexible flange; wherein complete insertion of the press fit bus bar into the chamber is indicated by a stop flange on the press fit bus bar being supported by the lock ridge, and incomplete insertion of the press fit bus bar into the chamber is indicated by the stop flange pressing the flexible flange outward in a direction opposite to the projecting direction of the lock ridge.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

Figure 1:
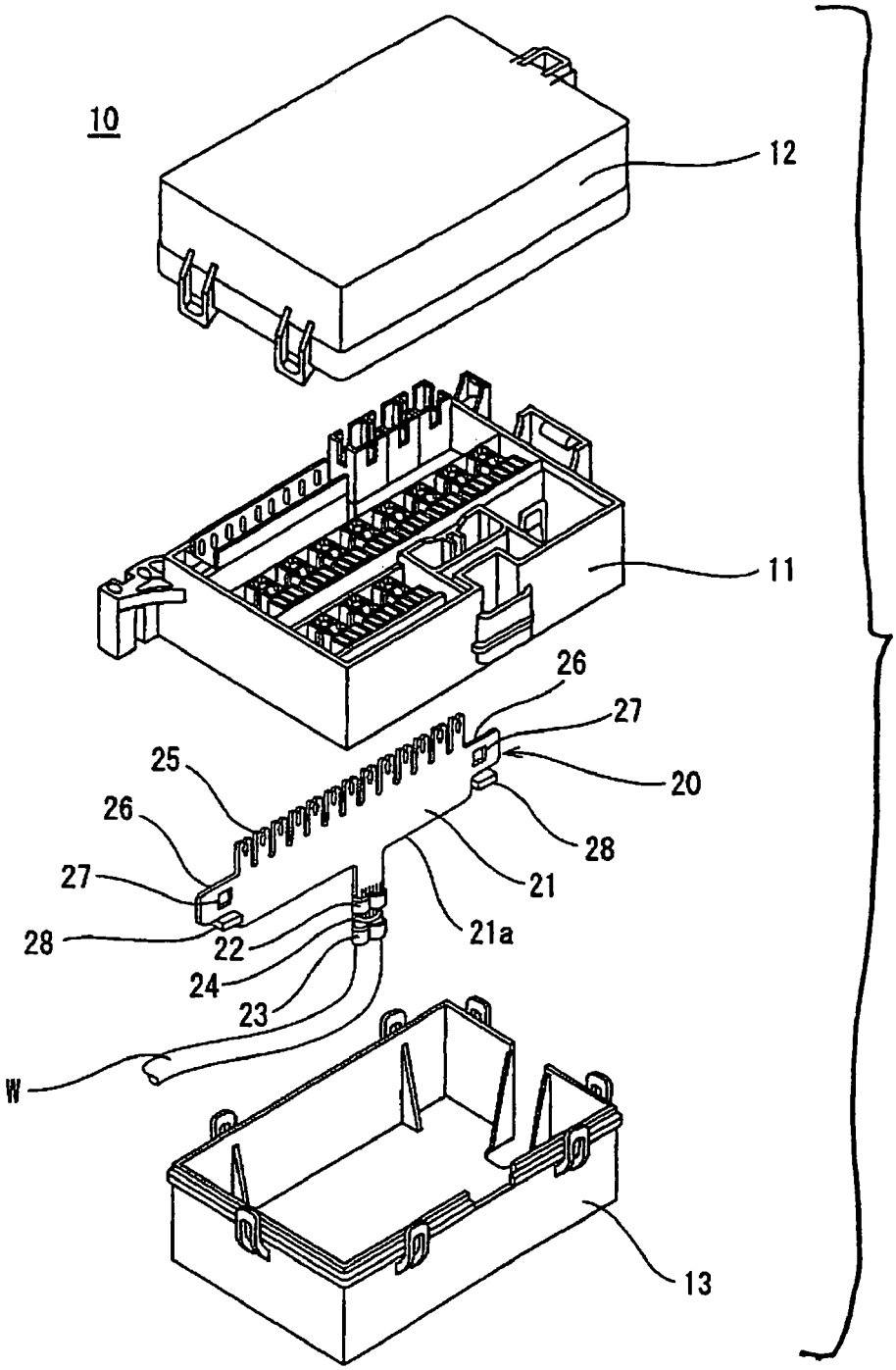
FIG. 1 is a perspective view of an electrical connector box of a first embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe embodiments of the invention with reference to the attached drawings. FIGS. 1 through 5 illustrate a first embodiment of the present invention in the form of an incomplete insertion indicating structure applied to electrical connector box 10, and the relay box housed therein, which may be installed within the engine compartment of an automobile.

Electrical connector box 10 is assembled by joining upper cover 12 and lower cover 13 to enclose relay box 11, which houses press fit bus bar 20 (hereafter referred to as bus bar 20). Bus bar 20 is initially inserted and locked into bus bar chamber 14 in relay box 11 from below. The connector tabs of relays, fuses, and other electrical components (not shown in the drawings) installed at the top of relay box 11 are pressed into tuning fork-shaped terminals 25 of bus bar 20 in order to obtain electrical power from wire W which is connected thereto.

Figure 4A:
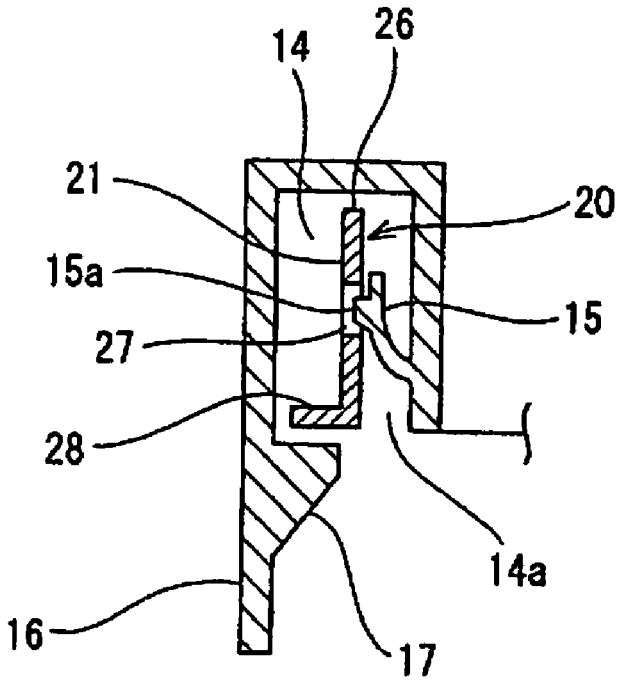
FIG. 4A is a cross sectional view of the bus bar of the embodiment of FIG. 1 in the specified insertion position.
Figure 4B:
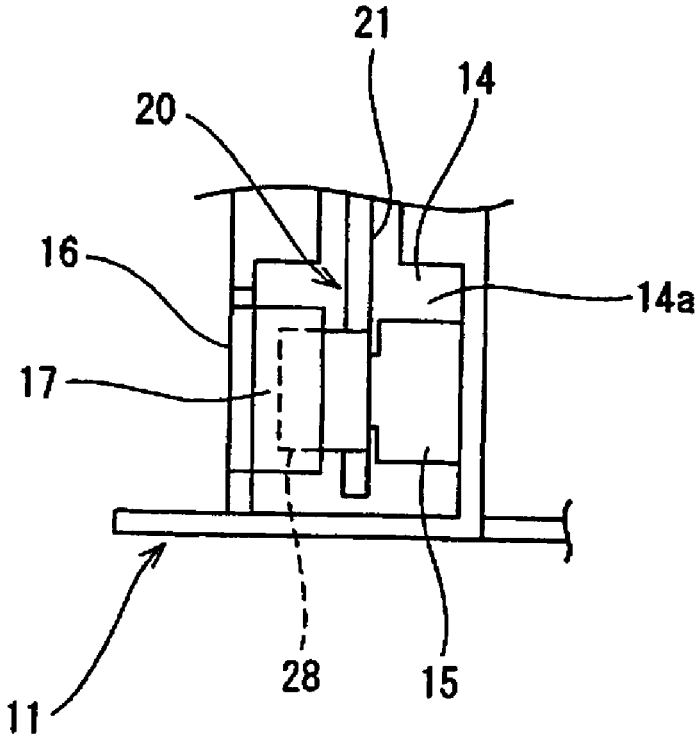
FIG. 4B is a bottom view of the bus bar of the embodiment of FIG. 1 in the specified insertion position.

As shown in FIGS. 4A and 4B, stop pawl or lock pawl 15, on which stop dog 15*a* is provided, extends from a sidewall into left and right sides 14*a* and 14*b* of bus bar chamber 14 (left side 14*a* only is shown in the figure). Further, flexible flange 16 extends downward from the sidewall of bus bar chamber 14 on the side of the chamber opposite to stop pawl 15. Flexible flange 16 may be formed integrally and in one piece with the sidewall of the bus bar chamber 14. Once bus bar 20 is inserted, lock ridge 17, which projects from flexible flange 16, supports bus bar 20 from below in the specified installation position within bus bar chamber 14.

Figure 2:
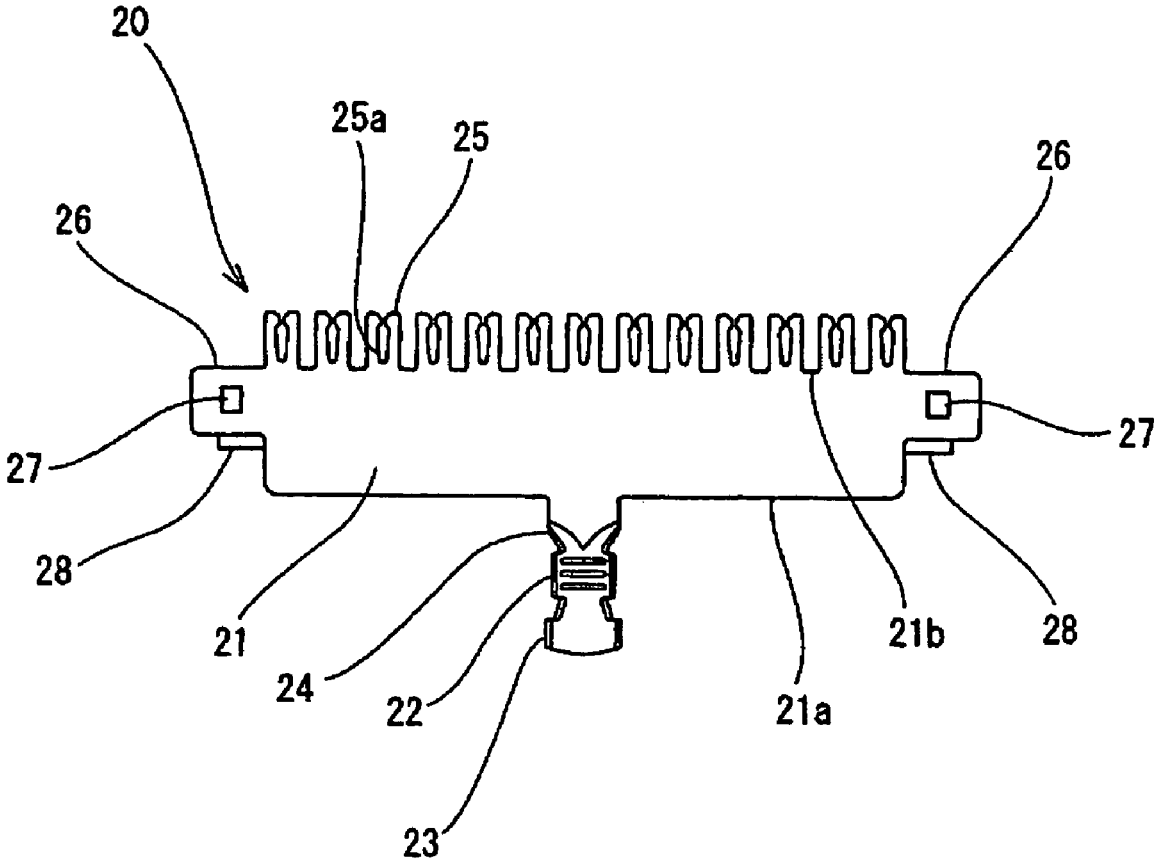
FIG. 2 is a front elevational view of the press fit bus bar of the embodiment of FIG. 1.
Figure 3:
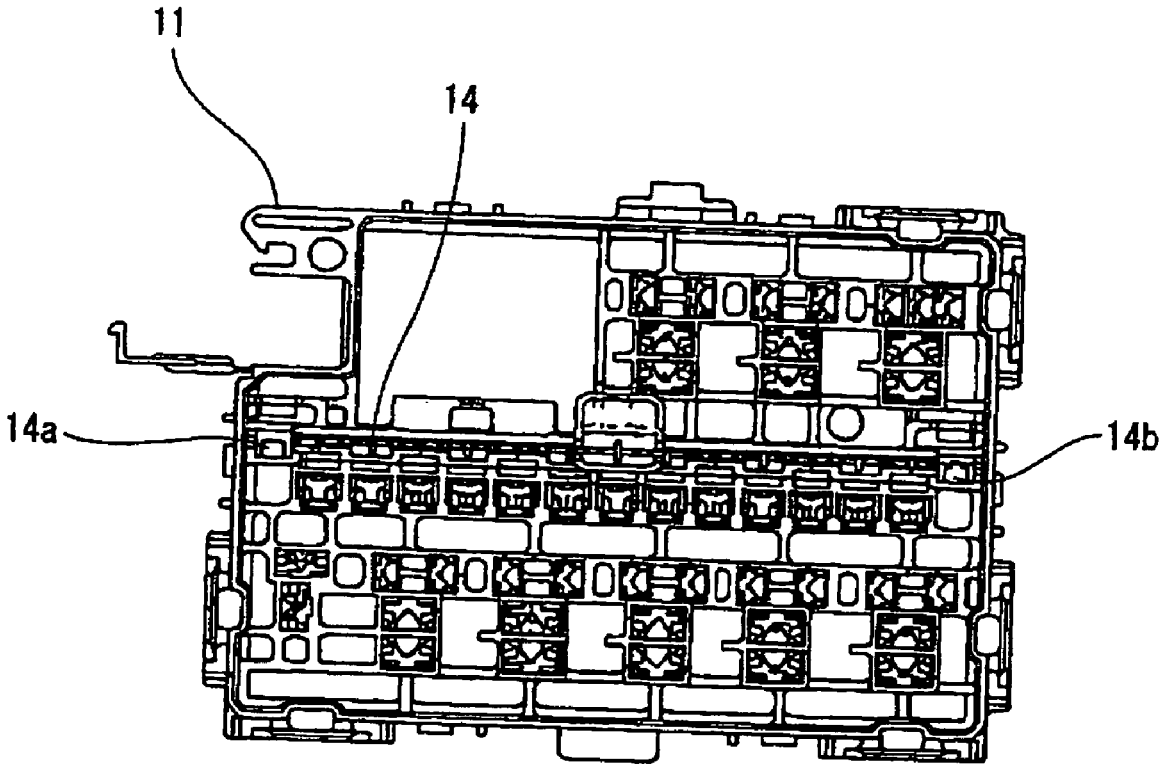
FIG. 3 is a bottom view of the relay box of the electrical connector box of the embodiment of FIG. 1.

As shown in FIG. 2, bus bar 20 may be press blanked from an electrically conductive metal plate, and includes wire crimping portion 24, on which wire core and insulation crimping barrels 22 and 23 are provided. The insulation crimping barrels 22, 23 extend from long edge 21*a* of horizontally oriented base plate 21. Terminal insertion slots 25*a* are formed in each of multiple tuning fork-shaped terminals 25 that are aligned in a row on long edge 21*b* at the side of bus bar 20 opposite long edge 21*a*. Additionally, bus bar mounting plates 26 are provided at the short sides of base plate 21, that is, at the left and right sides of base plate 21 bordering tuning fork-shaped terminals 25. As can be seen in FIGS. 4A and 4B, lock aperture 27 is formed within each bus bar mounting plate 26 so as to assume a position opposing stop dog 15*a* of stop pawl 15 when bus bar 20 is inserted into bus bar chamber 14. Moreover, stop flange 28 is formed as a bent flanged portion on the lower side of each bus bar mounting plate 26.

When bus bar 20 is inserted into bus bar chamber 14, stop flange 28 moves up against the inclined surface of lock ridge 17, pushes flexible flange 16 outward in a direction opposite to the projecting direction of lock ridge 17, and in this embodiment rises up over lock ridge 17 after which flexible flange 16 returns to its inwardly oriented position with bus bar 20 completely inserted in its specified position. As shown in FIGS. 4A and 4B, when bus bar 20 has been inserted completely in the specified position, stop dog 15*a* of stop pawl 15 (stop pawl 15 being a member that projects into right and left sides 14*a* and 14*b* of bus bar chamber 24) enters right and left lock apertures 27 of bus bar 20 while stop flange 28 of bus bar 20 is supported from below by lock ridge 17 on flexible flange 16. Therefore, as illustrated in FIG. 4B, the structure of relay box 11 makes it possible to visibly verify that lock ridge 17 has returned fully within bus bar chamber 14 (side 14*a* being illustrated in the drawing) because flexible flange 16 is not bent outward, and stop flange 28 of bus bar 20 is covered by lock ridge 17.

Figure 5A:
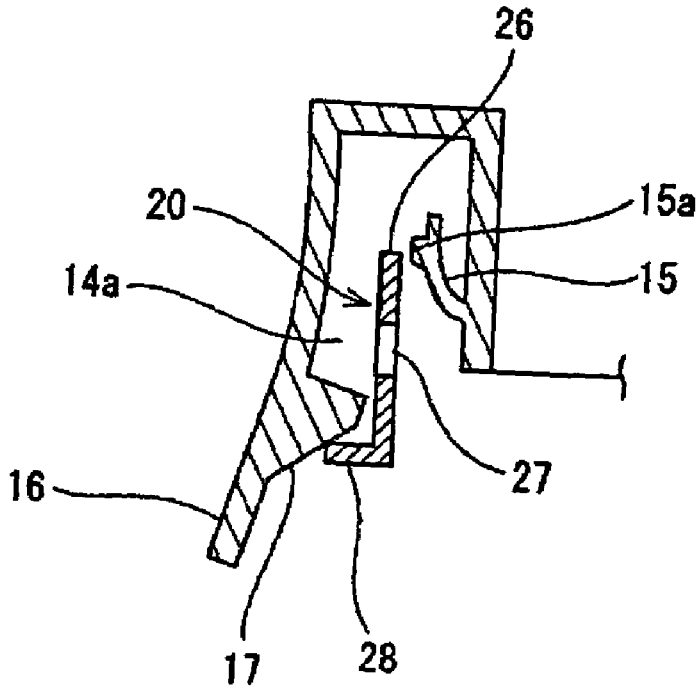
FIG. 5A is cross sectional view of the bus bar of the embodiment of FIG. 1 in a partially inserted position.
Figure 5B:
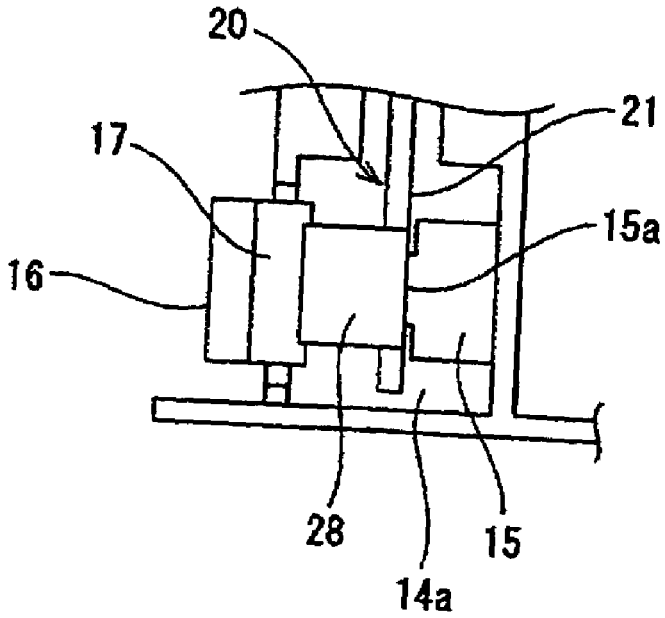
FIG. 5B is a bottom view of the bus bar of the embodiment of FIG. 1 in a partially inserted position.

Conversely, in the event that bus bar 20 has not been completely inserted, as shown in FIGS. 5A and 5B, stop dog 15*a* of stop pawl 15 does not enter lock aperture 27 on bus bar 20, stop flange 28 of bus bar 20 is not supported over lock ridge 17 of flexible flange 16, and flexible flange 16 is pressed outward in a direction opposite to the inward protruding direction of lock ridge 17. Therefore, this incompletely assembled condition can be detected by visibly determining that flexible flange 16 is bent outward and stop flange 28 is exposed on lock ridge 17.

Applying the structure described by this embodiment, a visible inspection of relay box 11, after the insertion of bus bar 20, is able to verify if flexible flange 16 is bent outward, and if stop flange 28 of bus bar 20 is exposed as a result of not being covered by lock ridge 17, thus making it possible to visually determine if bus bar 20 has been completely inserted into relay box 11. As a result, the inspection process is easily conducted and the reliability of the inspection improved. Moreover, production costs are lowered because a special detection mechanism is not required.

Figure 6A:
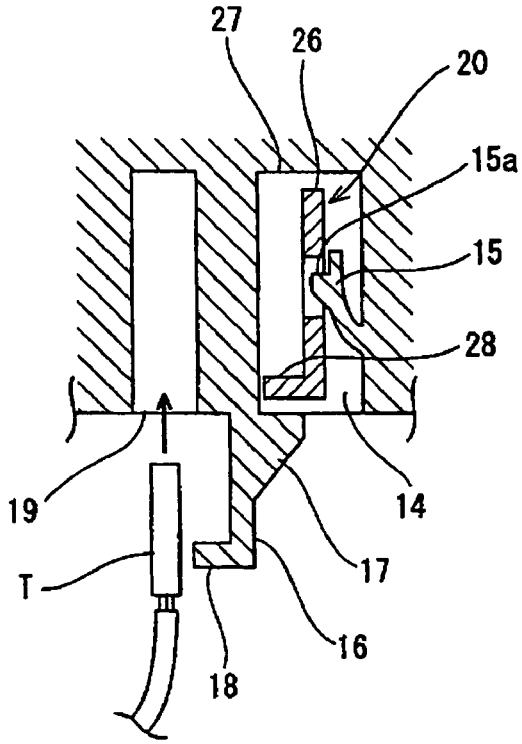
FIG. 6A is a cross sectional view of an electrical connector box of a second embodiment of the present invention showing the bus bar in the specified insertion position.
Figure 6B:
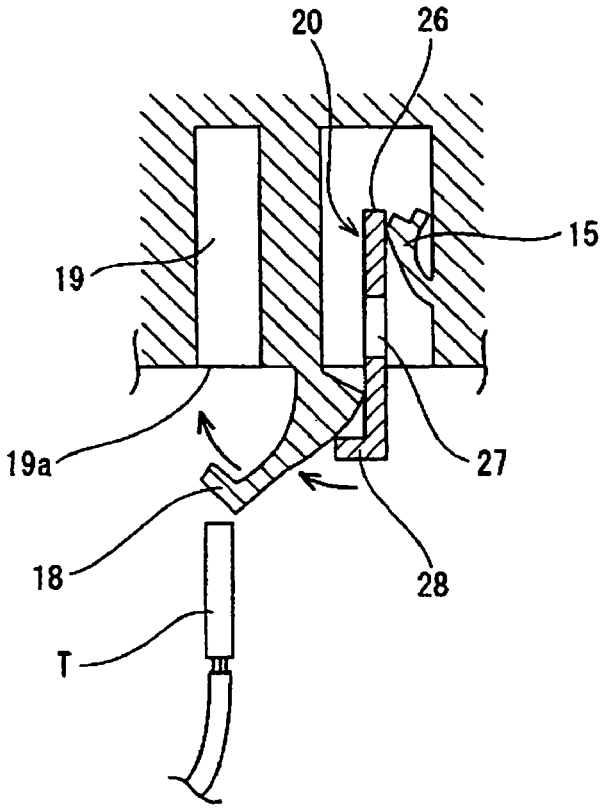
FIG. 6B is a cross sectional view showing the bus bar of the embodiment of FIG. 6A in a partially inserted position.

FIGS. 6A and 6B illustrate a second embodiment of the present invention in which the lower end of flexible flange 16 (provided at left and right sides 14*a* and 14*b* of bus bar chamber 14) is bent to form lip 18 extending in the direction opposite lock ridge 17. A description of the other elements of the second embodiment will be omitted as they are identical to and indicated by the same element identification numbers noted in the first embodiment.

In particular, lip 18 is formed on the end of flexible flange 16 on the side opposite to lock ridge 17, but to an extent that does not block terminal insertion cavity 19 which is formed on the side of flexible flange 16 opposite to bus bar chamber 14. If bus bar 20 has not been fully inserted, this structure causes stop flange 28 to press flexible flange 16 and lip 18 outward to a point where lip 18 blocks opening 19*a* at the entrance to terminal insertion cavity 19, thus interfering with the insertion of terminal T into cavity 19. Therefore, in the unlikely event that the technician forgets to inspect the bottom of relay box 11, terminal T cannot be inserted into terminal insertion cavity 19 at a later point in the assembly process, thus making it certain that the incomplete insertion condition of bus bar 20 will be noticed.

Figure 7:
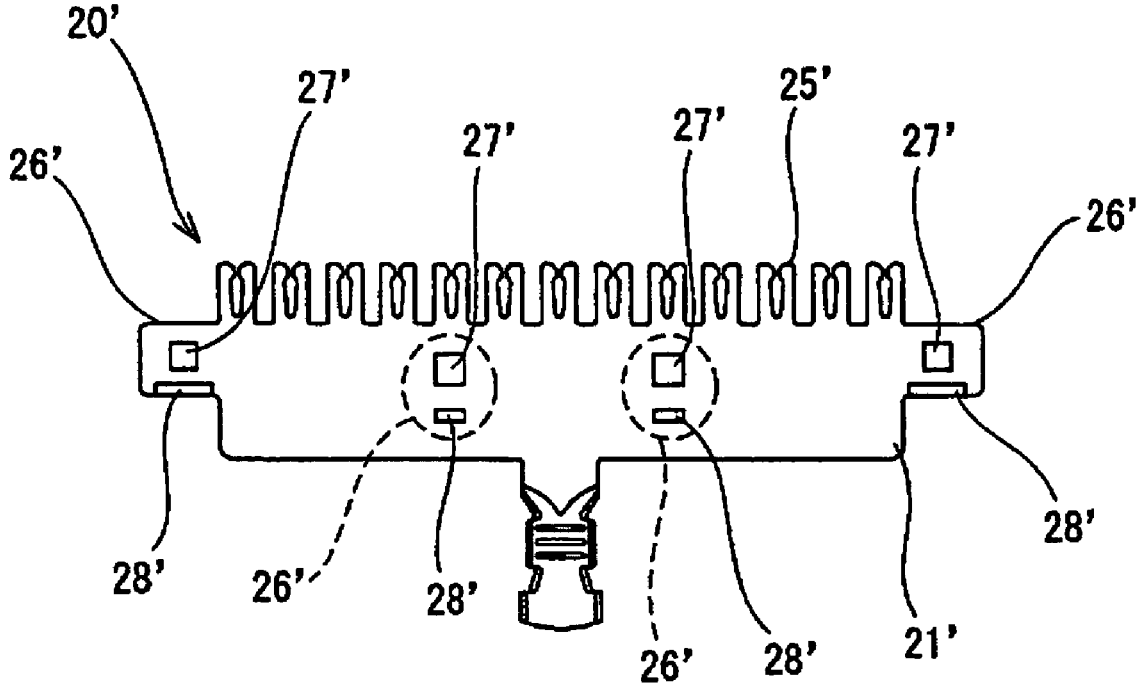
FIG. 7 is a front elevational view of the bus bar of a third embodiment of the FIG. 8 illustrates a conventional electrical connector box.
Figure 8:
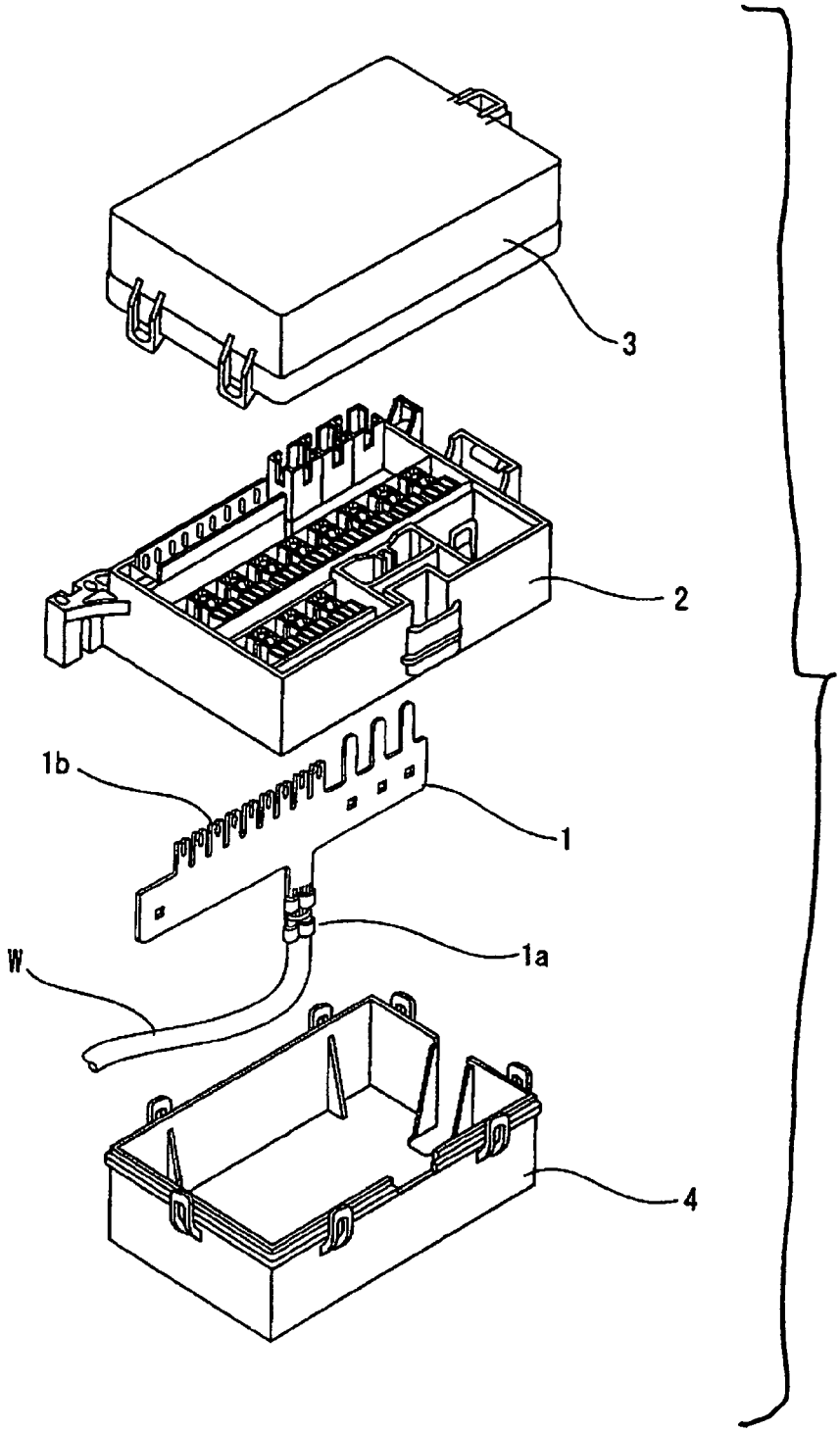
FIG.8 Prior Art
Figure 9A:
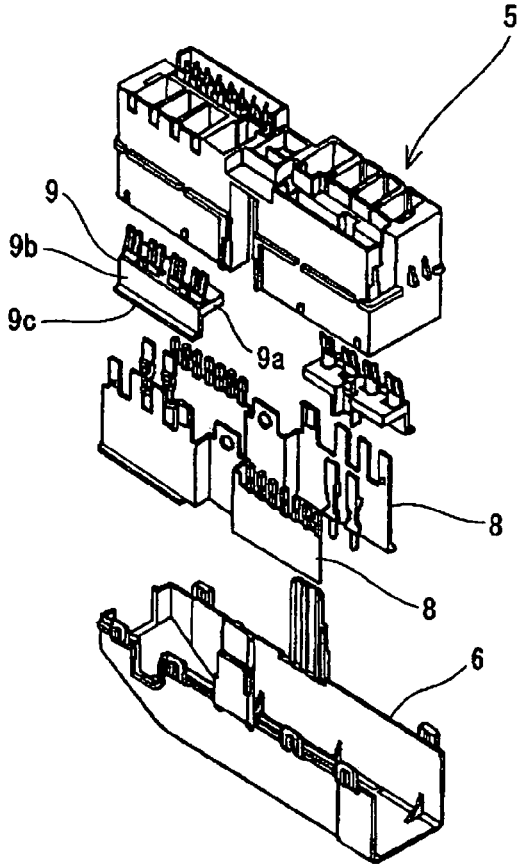
FIG.9A Prior Art
FIGS. 9A and 9B illustrate a conventional electrical connector box.
Figure 9B:
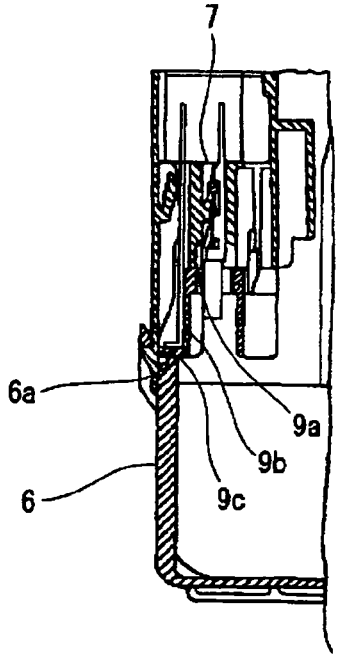
FIG.9B Prior Art

FIG. 7 describes a third embodiment of the present invention in which two bus bar mounting plates 26' are formed within the center portion of horizontally oriented base plate 21' of bus bar 20' in addition to the mounting plates located at the ends of base plate 21', thus providing a total of four mounting plates. Each mounting plate 26' includes both lock aperture 27' and a stop flange 28'. Other portions of bus bar 20' do not differ from the first and second embodiments.

By providing bus bar mounting plates 26' at the center of base plate 21', bus bar 20' can be more uniformly secured within bus bar chamber 14. This structure becomes especially beneficial when bus bar 20' is formed having a greater length that includes a large number of tuning-forked shaped terminals 25' because more support is provided for terminals 25' to insure complete connection with their mating terminals.

As previously noted, the present invention provides a structure whereby an external visual examination of the insertion side of the bus bar chamber, at the time that the bus bar is placed in the electrical connector box, is able to determine if the flexible flange portion of the bus bar chamber sidewall is projecting in the direction opposite to the lock ridge (e.g. projecting outward). The visual examination can also determine if the lock ridge formed on the flexible flange portion is covering the stop flange. This structure therefore eliminates the need for a special mechanism to indicate that the bus bar has only been partially inserted into the bus bar chamber. It also lowers costs and provides a dependable method of recognizing a partially joined condition.

Moreover, a projecting lip, which is formed on the side of the flexible flange opposite the lock ridge, will bend outward in the direction opposite the lock ridge if the bus bar has not been completely inserted. A terminal insertion cavity is provided adjacent to the flexible flange at a position where the cavity is blocked by the outwardly bent flexible flange. Therefore, the inability to insert a terminal in the cavity indicates that the bus bar has only been partially inserted and that the initial visual inspection was not conducted. This structure thus provides a highly dependable method of indicating a faulty bus bar insertion condition.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2003-203781, filed on Jul. 30, 2003, which is herein expressly incorporated by reference in its entirety.

What is claimed is:

1. A bus bar insertion indication device for an electrical connector box, said electrical connector box comprising:

a chamber within said electrical connector box, said chamber including sidewalls;

a press fit bus bar configured to be inserted into said chamber within the electrical connector box, said bus bar including a base plate, a wire crimping portion formed on one edge of said base plate, and electrical component connecting terminals projecting from a second edge of said base plate;

a lock aperture provided on said press fit bus bar;

a stop flange provided on said base plate of said press fit bus bar, said stop flange including a bent portion spaced from said lock aperture;

a lock pawl provided on a first sidewall of said chamber, and a stop dog provided on said lock pawl, said stop dog configured to be inserted into said lock aperture in said press fit bus bar; and a flexible flange extending from a sidewall of said chamber adjacent said stop flange, and a lock ridge projecting from said flexible flange, wherein complete insertion of said press fit bus bar into said chamber is indicated by said stop flange being supported by said lock ridge, and incomplete insertion of said press fit bus bar into said chamber is indicated by said stop flange pressing said flexible flange outward in a direction opposite to the projecting direction of said lock ridge.

2. The bus bar insertion indication device for an electrical connector box according claim 1, wherein said lock aperture and stop flange are provided on a side of the base plate at a position bordering said terminals that connect to electrical components.

3. The bus bar insertion indication device for an electrical connector box according to claim 1, further comprising:

a projecting lip portion provided on a lower end of said flexible flange and extending such that said projecting lip portion does not block a terminal insertion cavity provided adjacent said flexible flange;

wherein incomplete insertion of said press fit bus bar into said chamber is indicated by said press fit bus bar pressing said flexible flange outward so that said projecting lip portion blocks said terminal insertion cavity, thereby preventing the insertion of a terminal therein.

4. The bus bar insertion indication device for an electrical connector box according to claim 2, further comprising:

a second lock aperture provided on said press fit bus bar; and a second stop flange provided on said base plate of said press fit bus bar, said second stop flange including a bent portion spaced from said second lock aperture;

wherein said lock aperture and said stop flange, and said second lock aperture and said second stop flange, are provided on left and right sides, respectively, of said base plate at positions bordering said terminals that connect to electrical components.

5. The bus bar insertion indication device for an electrical connector box according to claim 1, wherein said lock pawl projects into said chamber from said sidewall of chamber.

6. The bus bar insertion indication device for an electrical connector box according to claim 5, wherein said lock pawl is formed integrally and in one piece with said chamber.

7. The bus bar insertion indication device for an electrical connector box according to claim 1, wherein said flexible flange is formed integrally and in one piece with said chamber.

8. The bus bar insertion indication device for an electrical connector box according to claim 1, wherein said flexible flange extends from a sidewall opposite said lock pawl, said lock ridge projecting toward said lock pawl.

9. The bus bar insertion indication device for an electrical connector box according to claim 1, further comprising:

a plurality of lock apertures provided on said press fit bus bar; and a plurality of stop flanges provided on said base plate of said press fit bus bar, said plurality of stop flanges each including a bent portion spaced from a respective lock aperture;

a plurality of lock pawls provided on a first sidewall of said chamber, and a stop dog provided on each of said plurality of lock pawls, said stop dogs configured to be inserted into a respective lock aperture in said press fit bus bar.

10. A bus bar insertion indication device for an electrical connector box comprising:

a press fit bus bar configured to be inserted into a chamber within the electrical connector box, said bus bar including a base plate, a wire crimping portion formed on one edge of said base plate, and electrical component connecting terminals projecting from a second edge of said base plate;

a lock aperture provided on said press fit bus bar; and a stop flange provided on said base plate of said press fit bus bar, said stop flange including a bent portion spaced from said lock aperture;

wherein complete insertion of said press fit bus bar into the chamber is indicated by said stop flange being supported by a lock ridge projecting from a flexible flange in the chamber, and incomplete insertion of said press fit bus bar into the chamber is indicated by said stop flange pressing the flexible flange outward in a direction opposite to the projecting direction of the lock ridge.

11. The bus bar insertion indication device for an electrical connector box according claim 10, wherein said lock aperture and said stop flange are provided on a side of the base plate at a position bordering said terminals that connect to electrical components.

12. The bus bar insertion indication device for an electrical connector box according to claim 10, further comprising:

a second lock aperture provided on said press fit bus bar; and a second stop flange provided on said base plate of said press fit bus bar, said second stop flange including a bent portion spaced from said second lock aperture;

wherein said lock aperture and said stop flange, and said second lock aperture and said second stop flange, are provided on left and right sides, respectively, of said base plate at positions bordering said terminals that connect to electrical components.

13. The bus bar insertion indication device for an electrical connector box according to claim 10, further comprising:

a plurality of lock apertures provided on said press fit bus bar; and a plurality of stop flanges provided on said base plate of said press fit bus bar, said plurality of stop flanges each including a bent portion spaced from a respective lock aperture.

14. A bus bar insertion indication device for an electrical connector box comprising:

a chamber within said electrical connector box, said chamber including sidewalls;

a lock pawl provided on a first sidewall of said chamber;

a stop dog provided on said lock pawl, said stop dog configured to be inserted into a lock aperture in a press fit bus bar; and a flexible flange extending from a sidewall of said chamber adjacent said stop flange, and a lock ridge projecting from said flexible flange, wherein complete insertion of the press fit bus bar into said chamber is indicated by a stop flange on the press fit bus bar being supported by said lock ridge, and incomplete insertion of the press fit bus bar into said chamber is indicated by the stop flange pressing said flexible flange outward in a direction opposite to the projecting direction of said lock ridge.

15. The bus bar insertion indication device for an electrical connector box according to claim 14, further comprising:

a projecting lip portion provided on a lower end of said flexible flange and extending such that said projecting lip portion does not block a terminal insertion cavity provided adjacent said flexible flange;

wherein incomplete insertion of the press fit bus bar into said chamber is indicated by the press fit bus bar pressing said flexible flange outward so that said projecting lip portion blocks said terminal insertion cavity, thereby preventing the insertion of a terminal therein.

16. The bus bar insertion indication device for an electrical connector box according to claim 14, wherein said lock pawl projects into said chamber from said sidewall of chamber.

17. The bus bar insertion indication device for an electrical connector box according to claim 14, wherein said lock pawl is formed integrally and in one piece with said chamber.

18. The bus bar insertion indication device for an electrical connector box according to claim 14, wherein said flexible flange is formed integrally and in one piece with said chamber.

19. The bus bar insertion indication device for an electrical connector box according to claim 14, wherein said flexible flange extends from a sidewall opposite said lock pawl, said lock ridge projecting toward said lock pawl.

20. The bus bar insertion indication device for an electrical connector box according to claim 14, further comprising:

a plurality of said lock pawls provided on a first sidewall of said chamber, and a stop dog provided on each of said plurality of said lock pawls, said stop dogs configured to be inserted into a respective lock aperture in the press fit bus bar.

* * * * *